US010174506B2

(12) United States Patent
Kim

(10) Patent No.: US 10,174,506 B2
(45) Date of Patent: Jan. 8, 2019

(54) ELASTIC FOOTHOLD FOR STAIRS

(71) Applicant: Tae Joong Kim, Anyang-si (KR)

(72) Inventor: Tae Joong Kim, Anyang-si (KR)

( * ) Notice: Subject to any disclaimer, the term of this patent is extended or adjusted under 35 U.S.C. 154(b) by 0 days.

(21) Appl. No.: 15/768,499

(22) PCT Filed: Oct. 10, 2016

(86) PCT No.: PCT/KR2016/011316
§ 371 (c)(1),
(2) Date: Apr. 13, 2018

(87) PCT Pub. No.: WO2017/065469
PCT Pub. Date: Apr. 20, 2017

(65) Prior Publication Data

US 2018/0313091 A1 Nov. 1, 2018

(30) Foreign Application Priority Data

Oct. 13, 2015 (KR) ..... 10-2015-0142926

(51) Int. Cl.
*E04F 11/104* (2006.01)
*E04F 11/17* (2006.01)
*E04F 15/22* (2006.01)

(52) U.S. Cl.
CPC ..... *E04F 11/17* (2013.01); *E04F 15/225* (2013.01); *E04F 2011/1046* (2013.01)

(58) Field of Classification Search
CPC . E04F 11/17; E04F 2011/1046; E04F 15/225; A63B 5/08; A63B 2005/085
(Continued)

(56) References Cited

U.S. PATENT DOCUMENTS 1,210,920 A * 1/1917 Fletcher ..... A63B 5/10 16/404
2,024,028 A * 12/1935 Dahlberg ..... A63B 5/10 267/173

(Continued)

FOREIGN PATENT DOCUMENTS

JP 07-038380 U 7/1995
JP 2001-87412 A 4/2001

(Continued)

*Primary Examiner* — Brent W Herring
(74) *Attorney, Agent, or Firm* — Maschoff Brennan

(57) ABSTRACT

The present invention relates to an elastic foothold for stairs comprising: an upper plate, wherein one or more first coupling protrusions are formed on a side of a bottom surface, one or more first block insertion parts having second coupling protrusions are formed on the other side of the bottom surface, and a first anti-slip part is formed on a side of a top surface; a lower plate, wherein first coupling grooves corresponding to the first coupling protrusions are formed on a side of the bottom surface so as to be male/female-coupled to a side of the upper plate, and one or more second block insertion parts having third coupling protrusions are formed on the other side of the bottom surface; one or more first blocks that are inserted and coupled to the first block insertion parts, that have second coupling grooves formed on a bottom surface so as to be male/female-coupled to the second coupling protrusions, and that have third coupling grooves formed on a top surface; one or more second blocks that are inserted and coupled to the second block insertion parts, that have fourth coupling grooves formed on a bottom surface so as to be male/female-coupled to the third coupling protrusions, and that have fifth coupling grooves formed on a top surface; and one or more first elastic members, wherein both ends are respectively fixed to the fourth coupling grooves and the fifth coupling grooves between the first blocks and the second blocks. According to (Continued)

the present invention, an elastic foothold for stairs that can be fixed to stairs and that minimises shock applied to feet when climbing up and down the stairs so as to be able to prevent harmful effects on joints such as knees of a walker can be provided.

5 Claims, 5 Drawing Sheets

(58) Field of Classification Search
USPC ..... 52/177, 179, 183, 188, 191; 482/30, 31
See application file for complete search history.

(56) References Cited

U.S. PATENT DOCUMENTS 3,516,660 A * 6/1970 Bellinson ..... A63B 5/10 482/31
3,856,296 A * 12/1974 Fischer ..... A63B 5/10 482/31
5,209,709 A * 5/1993 Eyman, Jr. ..... A63B 5/08 482/26
5,352,173 A * 10/1994 McLaughlin .... A63B 23/03575 482/121
5,634,870 A * 6/1997 Wilkinson ..... A63B 5/11 482/27
6,053,851 A * 4/2000 Tu ..... A63B 21/0004 482/121
6,598,365 B2 * 7/2003 Abraham ..... E04F 15/225 267/160
6,705,975 B2 * 3/2004 Kuo ..... A63B 22/0056 482/51
7,175,567 B2 * 2/2007 Barbafieri ..... A63B 5/08 482/30
7,803,097 B2 * 9/2010 Araujo ..... A63B 21/00181 482/142
7,849,646 B2 * 12/2010 Harinishi ..... E04F 15/225 248/633
7,993,244 B2 * 8/2011 Weller ..... A63B 5/08 482/23
8,337,368 B2 * 12/2012 Weller ..... A63B 5/08 267/166
9,017,237 B2 * 4/2015 Araujo ..... A63B 21/00181 482/142
9,446,276 B2 * 9/2016 Araujo ..... A63B 21/00181
2004/0235620 A1 * 11/2004 Barbafieri ..... A63B 5/08 482/31
2009/0139172 A1 * 6/2009 Harinishi ..... E04F 15/22 52/403.1
2009/0305849 A1 * 12/2009 Weller ..... A63B 5/08 482/26
2011/0263343 A1 * 10/2011 Weller ..... A63B 5/08 472/92

FOREIGN PATENT DOCUMENTS

KR 20-0246164 Y1 10/2001
KR 10-0564247 B1 3/2006
KR 20-0441458 Y1 8/2008
KR 10-1122283 B1 3/2012

* cited by examiner

[FIG.1]
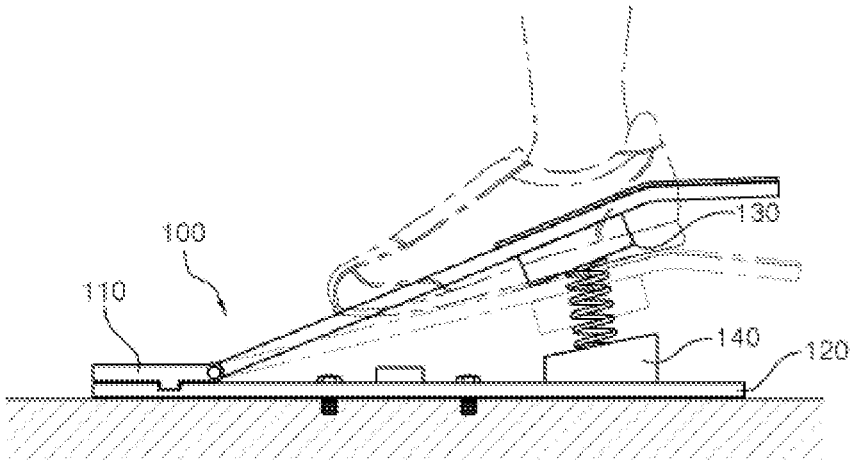

[FIG.2]
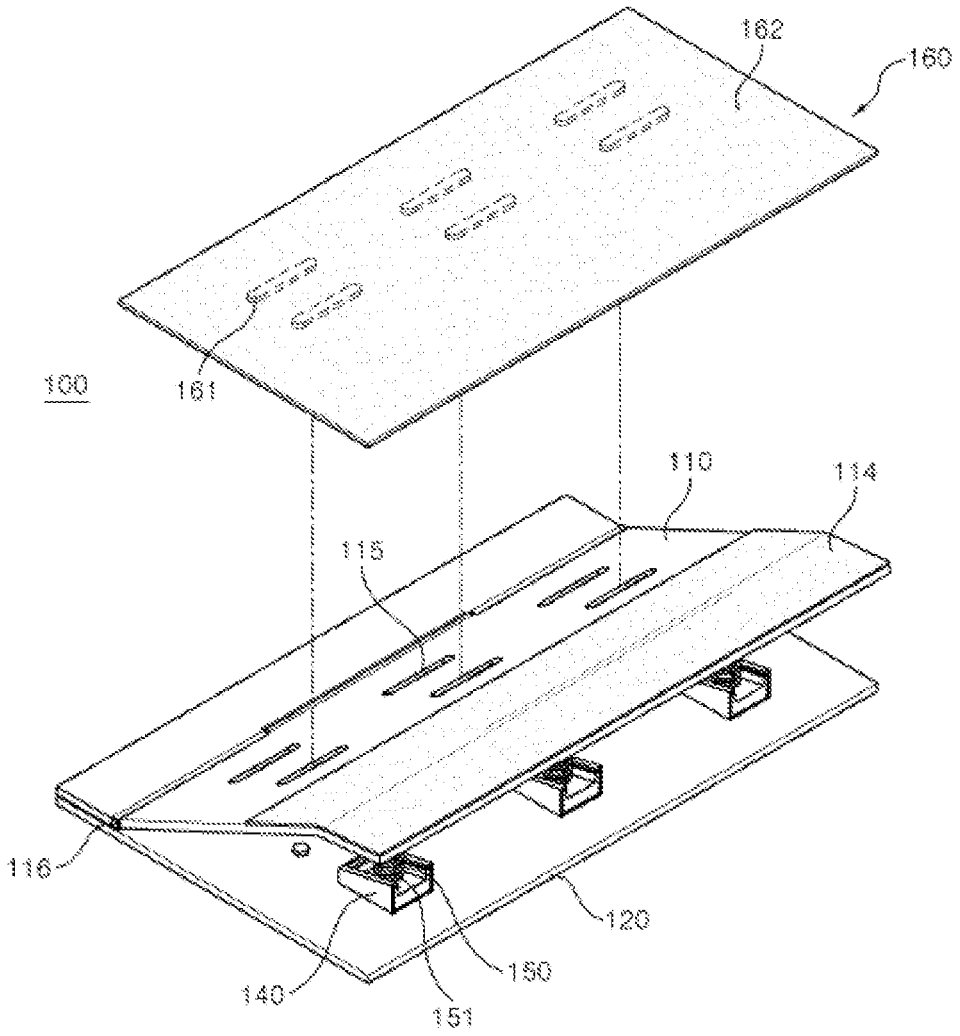

[FIG.3]
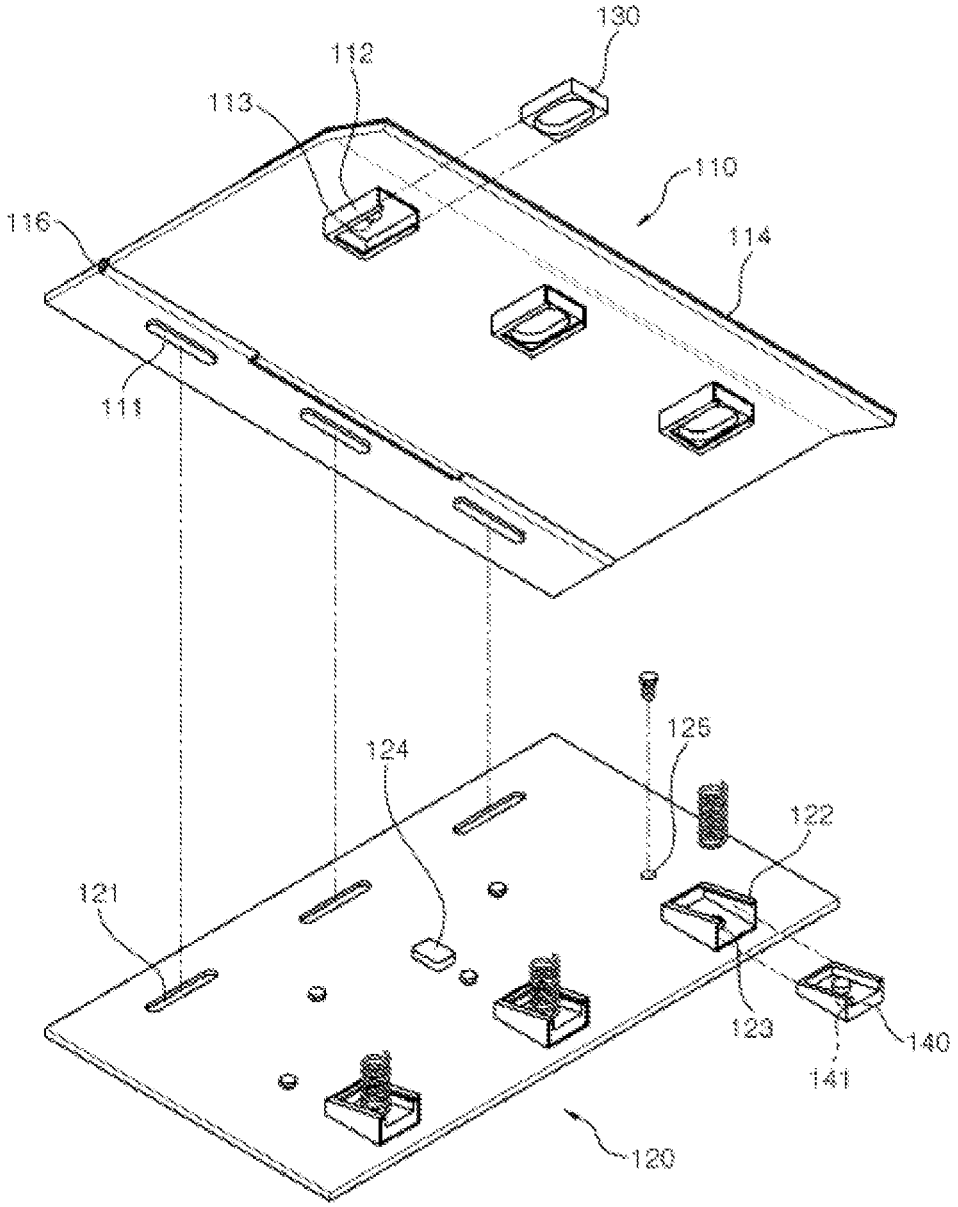

[FIG.4]
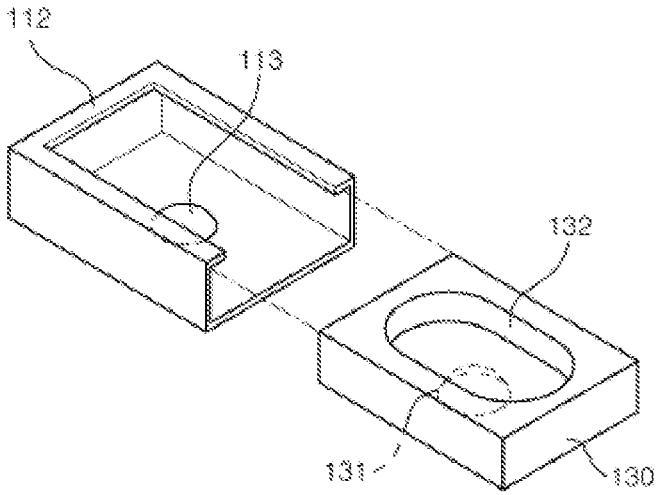
[FIG.5]
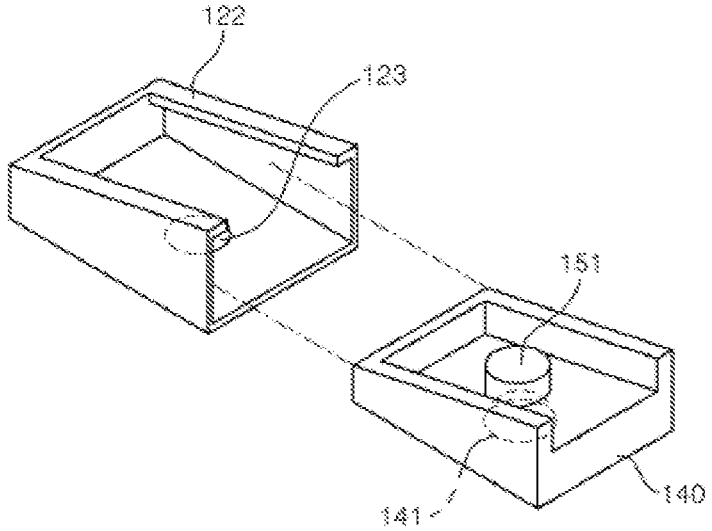

[FIG.6]
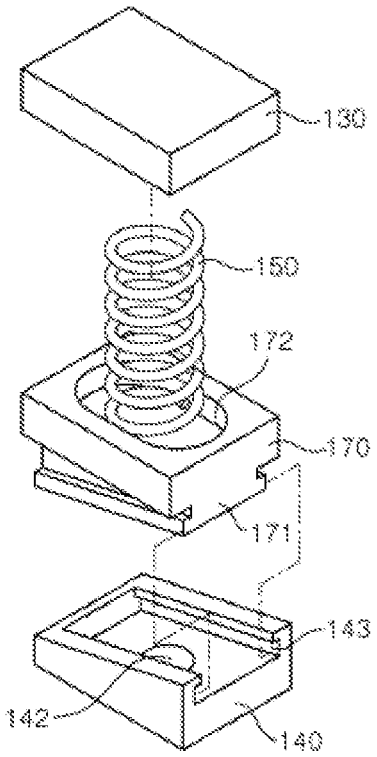

ELASTIC FOOTHOLD FOR STAIRS

TECHNICAL FIELD

The present invention relates to an elastic foothold for stairs, and more particularly, to an elastic foothold for stairs that can be fixed to stairs and that can minimize shock applied to users' feet so as to prevent harmful effects on the users' joints such as the knees when the users walk up and down the stairs.

RELATED ART

The present invention relates to an elastic foothold for stairs.

In general, walking down a staircase induces shock that can have a harmful effect on the joints such as the knees and fatigue caused by an accumulation of the shock.

Further, in the case that a staircase is washed and then, has some moisture left on the staircase, the elderly and children may slip on the staircase and may be at high risk of injury.

A non-slip structure has been devised as a means to solve such problems. However, the non-slip structure, in which synthetic rubber or metals that went through the extrusion molding process are attached to the ends of a flight of steps, is easily damaged, has a short lifespan and not that effective in preventing slips.

[Related Art Document] Korean Utility Model No. 20-0441458

DESCRIPTION OF THE INVENTION

Technical Problems

As a means to solve the above-described problems, the present invention is directed to providing an elastic foothold for stairs that can be fixed to stairs and that can minimize shock applied to users' feet so as to prevent harmful effects on the users' joints such as the knees when the users walk up and down the stairs.

Further, the present invention is directed to providing an elastic foothold for stairs that can prevent the users from slipping on the stairs thereby helping the users to avoid the risk of injury when the users walk up and down the stairs.

Further, the present invention is directed to providing an elastic foothold for stairs that can be easily assembled and disassembled so as to be installed wherever the users want.

Further, the present invention is also directed to providing an elastic foothold for stairs in which a plurality of blocks engaged to both of the ends of a support member can be assembled so as to easily adjust the buffering level of the elastic foothold for stairs depending on the users' needs.

Further, objects, features, and advantages of the present invention will be apparent to those skilled in the art from the following description of the preferred embodiments.

Technical Solutions

As a means to achieve the above-described purposes, the present invention includes an upper plate 110 having one or more first coupling protrusions 111 formed on one side of a bottom surface of the upper plate, one or more first block insertion parts 112 provided with second coupling protrusions 113 and formed on the other side of the bottom surface of the upper plate, and a first anti-slip part 114 formed on the other side of a top surface of the upper plate; a lower plate 120 having first coupling grooves 121 corresponding to the first coupling protrusions 111 and formed on one side of a top surface of the lower plate so as to be male-female coupled to one side of the upper plate 110, and one or more second block insertion parts 122 provided with third coupling protrusions 123 and formed on the other side of the top surface of the lower plate; one or more first blocks 130 inserted into and coupled to the first block insertion parts 112, and having second coupling grooves 131 formed on bottom surfaces of the first blocks so as to be male-female coupled to the second coupling protrusions 113 and third coupling grooves 132 formed on top surfaces of the first blocks; one or more second blocks 140 inserted into and coupled to the second block insertion parts 122, and having fourth coupling grooves 141 formed on bottom surfaces of the second blocks so as to be male-female coupled to the third coupling protrusions 123 and support members 151 formed on top surfaces of the second blocks; and one or more first elastic members 150 having both of the ends thereof respectively fixed between the first blocks 130 and the second blocks 140 to the third coupling grooves 132 and the support members 151.

Further, the upper plate 110 further has one or more sixth coupling grooves 115 formed on the top surface of the upper plate 110, and the elastic foothold for stairs further includes an anti-slip plate 160 having fourth coupling protrusions 161 formed on a bottom surface of the anti-slip plate 160 and corresponding to the sixth coupling grooves 115 so as to be male-female coupled to the top surface of the upper plate 110, and a second anti-slip part 162 formed on the top surface of the anti-slip plate 160.

Further, one or more guide rails are respectively formed from one side to the other of the bottom surface of the upper plate 110 and the top surface of the lower plate 120 such that the first block insertion parts 112 and the second block insertion parts 122 may move along the guide rails.

Further, the elastic foothold for stairs further includes third blocks 170 having guide coupling parts 171 formed on bottom surfaces of the third blocks and corresponding to guide parts 143 formed on the top surfaces of the second blocks 140 so as to be coupled to the top surfaces of the second blocks 140, and both of the ends of the first elastic members 150 are respectively coupled to the third coupling grooves 132 and seventh coupling grooves 172.

Further, the first elastic members consist of springs coated with rubber, and the first elastic members further have support members installed in the central space of the first elastic members.

Advantageous Effects

As described above, the present invention is directed to providing an elastic foothold for stairs that can be fixed to stairs and that can minimize shock applied to users' feet so as to prevent harmful effects on the users' joints such as the knees when the users walk up and down the stairs.

Further, the present invention is directed to providing an elastic foothold for stairs that can prevent the users from slipping on the stairs thereby helping the users to avoid the risk of injury when the users walk up and down the stairs.

Further, the present invention is directed to providing an elastic foothold for stairs that can be easily assembled and disassembled so as to be installed wherever the users want.

Further, the present invention is also directed to providing an elastic foothold for stairs in which a plurality of blocks engaged to both of the ends of a support member can be assembled so as to easily adjust the buffering level of the elastic foothold for stairs depending on the users' needs.

BRIEF DESCRIPTION OF THE DRAWINGS

FIG. 1 is a view illustrating how to use an elastic foothold for stairs according to the preferred embodiment of the present invention.

FIG. 2 is a perspective view of an elastic foothold for stairs according to the preferred embodiment of the present invention.

FIG. 3 is an exploded perspective view of an elastic foothold for stairs according to the preferred embodiment of the present invention.

FIG. 4 is a view illustrating the first block of an elastic foothold for stairs according to the preferred embodiment of the present invention.

FIG. 5 is a view illustrating the second block of an elastic foothold for stairs according to the preferred embodiment of the present invention.

FIG. 6 is a view illustrating how the first to third blocks of an elastic foothold for stairs according to the preferred embodiment of the present invention are coupled.

MODE FOR CARRYING OUT THE INVENTION

The advantages and features of the present invention and the method using thereof will become apparent to those skilled in the art from the following description of the preferred embodiments.

The inventive subject matter, however, may be embodied in various different forms, and should not be construed as being limited only to the illustrated embodiments. Rather, these embodiments are provided as examples so that this disclosure will be thorough and complete, and will fully convey the subject matter of the invention to those skilled in the art. The present invention should be considered as limited only by the scope of the appended claims. Unless otherwise noted, like reference numerals denote like elements throughout the attached drawings and written description.

Hereunder, an elastic foothold for stairs according to the embodiments of the present invention will be described by referring to the accompanying drawings.

FIG. 1 is a view illustrating how to use an elastic foothold for stairs according to the preferred embodiment of the present invention, and FIG. 2 is a perspective view of an elastic foothold for stairs according to the preferred embodiment of the present invention.

By referring to FIG. 1 and FIG. 2, an elastic foothold for stairs 100 according to the embodiments of the present invention includes an upper plate 110 and a lower plate 120 shaped like a wide plate and having one end of the upper plate and lower plate coupled to each other, first blocks 130 coupled to the other end of an inner surface of the upper plate 110, second blocks 140 coupled to the other end of an inner surface of the lower plate 120, and first elastic members 150 having both of the ends thereof respectively coupled to the first blocks 130 and the second blocks 140.

FIG. 3 is an exploded perspective view of an elastic foothold for stairs according to the preferred embodiment of the present invention.

By referring to FIGS. 1 to 3, the configuration of the upper plate 110 and the lower plate 120 of an elastic foothold for stairs will be described in detail.

The upper plate 110 preferably consists of glass fiber reinforced plastics (FRP) and has one or more first coupling protrusions 111 formed at one side of a bottom surface of the upper plate so as to be coupled to the lower plate 120. In this case, the first coupling protrusions 111 are preferably formed to ensure left-right symmetry such that the elastic foothold for stairs 100, in which the upper plate 110 and the lower plate 120 are coupled to each other, may have a solid structure.

Further, the upper plate 110 has first block insertion parts 112, to which the first blocks 130 are inserted and coupled, formed at the other side of the bottom surface of the upper plate 110.

In this case, the upper plate 110 has guide rails formed on the bottom surface of the upper plate from one side to the other side thereof such that the first block insertion parts 112 may move along the guide rails, thereby helping to easily adjust the buffering level the elastic foothold for stairs 100 depending on the user's needs.

The upper plate 110 has a protrusion-shaped first anti-slip part 114 formed at the other side of a top surface of the upper plate so as to prevent the user's feet, coming into contact with the upper plate 110, from sliding.

In particular, the first anti-slip part 114 consists of materials such as synthetic rubber etc. with a high level of friction so as to prevent the user from slipping in the case that the elastic foothold 100 for stairs is washed and then, has moisture left on the elastic foothold for stairs.

Further, the other end of the top surface of the upper plate 110 is bent or curved toward the lower plate 120 such that the user may easily take the user's foot off from the upper plate 110 after stepping on the upper plate 110.

Meanwhile, like the upper plate 110, the lower plate 120 preferably consists of glass fiber reinforced plastics (FRP) and has first coupling grooves 121 which have a position and shape corresponding to the position and shape of the first coupling protrusion 111 of the upper plate 110 and is formed at one side of a top surface of the lower plate 120 so as to be male-female coupled to the upper plate 110.

In this case, preferably, the upper plate 110 has a first hinge part 116 provided from left to right between the first coupling protrusions 111 and the first block insertion parts 112 of the upper plate 110 such that the hinge part may rotate with respect to the part of the lower plate 120, in which the first coupling protrusions 111 and the first coupling grooves 121 are male-female coupled.

Further, the lower plate 120 has second block insertion parts 122, to which the second blocks 140 are inserted and coupled, formed at the other side of the top surface of the lower plate 120.

In this case, the lower plate 120 has guide rails formed on the top surface of the lower plate from one side to the other side thereof such that the second block insertion parts 122 may move along the guide rails, thereby helping to easily adjust the buffering level of the elastic foothold for stairs 100 depending on the user's needs.

When the first block insertion parts 112 and the second block insertion parts 122 move respectively along the guide rails, the first block insertion parts 112 and the second block insertion parts 122 are preferably positioned to be parallel to each other, and the guide rails further include fixing members such that the first block insertion parts 112 and the second block insertion parts 122 are preferably fixed by the fixing members after the first block insertion parts 112 and the second block insertion parts 122 move along the guide rails.

Further, the lower plate 120 has a plurality of bolt holes 125 to couple the bolts inserted through the bolt holes 125 to stairs and to couple the elastic foothold for stairs 100 to the stairs. Further, the lower plate 120 may have a plurality of holes so as to lead to a reduction in the amount of the material.

FIG. 4 is a view illustrating the first block of an elastic foothold for stairs according to the preferred embodiment of the present invention.

By referring to FIG. 4, the first block 130 is configured to have a shape and size corresponding to the shape and size of the first block insertion part 112 so as to be coupled to the first block insertion part 112, and the first block 130 has a second coupling groove 131 which is formed at a bottom surface of the first block 130 and has a position and shape corresponding to the position and shape of a second coupling protrusion 113 formed at the center of the first block insertion part 112 such that the second coupling groove 131 may be settled by the second coupling protrusion 113, thereby ensuring a solid coupling with the second coupling protrusion, after the first block 130 slides into the first block insertion part 112.

Further, preferably, the first block 130 has a third coupling groove 132 formed on a top surface of the first block 130 and having a sectional shape and size corresponding to the sectional shape and size of the first elastic member 150.

FIG. 5 is a view illustrating the second block of an elastic foothold for stairs according to the preferred embodiment of the present invention.

By referring to FIG. 5, the second block 140 is configured to have a shape and size corresponding to the shape and size of the second block insertion part 122 so as to be coupled to the second block insertion part 122, and the second block 140 has a fourth coupling groove 141 which is formed at a bottom surface of the second block 140 and has a position and shape corresponding to the position and shape of a third coupling protrusion 123 formed at the center of the second block insertion part 122 such that the fourth coupling groove 141 may be settled by the third coupling protrusion 123, thereby ensuring a solid coupling with the third coupling protrusion, after the second block 140 slides into the second block insertion part 122.

Further, preferably, the second block 140 has a support member 151 which is formed on a top surface of the second block 140 and has a sectional shape and size corresponding to the sectional shape and size of the first elastic member 150.

By referring to FIGS. 2 to 5, the first elastic member 150 has both of the ends thereof respectively fixed between the first block 130 and the second block 140 to the third coupling groove 132 and the support member 151 such that the elastic foothold for stairs may function as a buffer.

In particular, the first elastic member 150 consists of a spring, and the life span of the spring may be lengthened in the case the spring is coated with rubber. The support member 151 formed on the top surface of the second block 140 is inserted into the empty space formed at the center of the first elastic member 150 so as to prevent the first elastic member 150 from escaping from the first block 130 and the second block 140.

By referring to FIG. 2, the upper plate 110 may further have one or more sixth coupling grooves 115 formed at the top surface of the upper plate 110. In this case, the plurality of sixth coupling grooves 115 are preferably formed to ensure left-right symmetry such that an anti-slip plate 160 may be coupled to the top surface of the upper plate 110.

The anti-slip plate 160 has one or more fourth coupling protrusions which are formed at a bottom surface of the anti-slip plate 160 and have shapes and positions corresponding to the shapes and positions of the six coupling grooves 115 so as to male-female couple and to fix the upper plate 110 to the anti-slip plate 160.

The anti-slip plate 160 preferably consists of materials such as synthetic rubber etc. with a high level of friction, and by referring to FIG. 2, the anti-slip plate 160 has a second anti-slip part 162 formed on a top surface of the anti-slip plate 160 so as to prevent the user's feet, coming into contact with the anti-slip plate 160, from sliding.

Further, the anti-slip plate 160 may be configured to have different shapes and sizes. In particular, as in FIG. 2, the anti-slip plate 160 is preferably configured to have a size and shape which are identical to the size and shape of the portion formed from the first hinge part 116 of the upper plate 110 to the bent potion of the upper plate 110 so as to be coupled to the upper plate 110. In this case, the anti-slip plate 160 may be coupled to the top surface of the upper plate 110 after the first anti-slip part 114 is removed, or the anti-slip plate 160 may be additionally coupled to the top surface of the upper plate 110 in the state in which the first anti-slip part 114 is not removed.

FIG. 6 is a view illustrating how the first to third blocks of an elastic foothold for stairs according to the preferred embodiment of the present invention are coupled.

By referring to FIG. 6, the elastic foothold for stairs 100 may further include a third block 170 capable of adjusting the buffer capacity of the elastic foothold for stairs 100, and the third block 170 is preferably configured to have the same size and shape as the first block 130. The third block 170 has a guide coupling part 171 which is formed on a bottom surface of the third block 170 and has a shape corresponding to the shape of a guide part 143 formed on the top surface of the second block 140 so as to be coupled to the second block 140.

Further, the third block 170 has a seventh coupling groove 172 which is formed on a top surface of the third block 170 and has a sectional shape and size corresponding to the sectional shape and size of the first elastic member 150 such that one end of the first elastic member 150, instead of the support member 151, may be coupled, and the other end may be coupled to the third coupling groove 132.

It will be apparent to those skilled in the art to which the present invention pertains that other modifications and changes may be made without departing from the spirit and scope of the invention. Accordingly, the present invention should not be construed as being limited to the embodiments set forth herein. Rather, the embodiments are provided as examples to describe the spirit of the invention. The scope of protection of the present invention should be determined only by the attached claims, and all the technical ideas within the appended claims and equivalents thereof should be construed as being included in the scope of the present invention.

DESCRIPTION OF SYMBOLS

100 Elastic foothold for stairs
110 Upper plate
111 First coupling protrusion
112 First block insertion part
113 Second coupling protrusion
114 First anti-slip part
115 Sixth coupling groove
116 Hinge part
120 Lower plate
121 First coupling groove
122 Second block insertion part
123 Third coupling protrusion

124 Fixing part
125 Bolt hole
130 First block
131 Second coupling groove
132 Third coupling groove
140 Second block
141 Fourth coupling groove
143 Guide part
150 First elastic member
151 Support member
160 Anti-slip plate
161 Fourth coupling protrusion
162 Second anti-slip part
170 Third block
171 Guide coupling part
172 Seventh coupling groove

The invention claimed is:

1. An elastic foothold for stairs comprising:

an upper plate having one or more first coupling protrusions formed on one side of a bottom surface of the upper plate, one or more first block insertion parts provided with second coupling protrusions and formed on the other side of the bottom surface of the upper plate, and a first anti-slip part formed on the other side of a top surface of the upper plate;

a lower plate having first coupling grooves corresponding to the first coupling protrusions and formed on one side of a top surface of the lower plate so as to be male-female coupled to one side of the upper plate, and one or more second block insertion parts provided with third coupling protrusions and formed on the other side of the top surface of the lower plate;

one or more first blocks inserted into and coupled to the first block insertion parts, and having second coupling grooves formed on bottom surfaces of the first blocks so as to be male-female coupled to the second coupling protrusions and third coupling grooves formed on top surfaces of the first blocks;

one or more second blocks inserted into and coupled to the second block insertion parts, and having fourth coupling grooves formed on bottom surfaces of the second blocks so as to be male-female coupled to the third coupling protrusions and support members formed on top surfaces of the second blocks; and one or more first elastic members having both of the ends thereof respectively fixed between the first blocks and the second blocks to the third coupling grooves and the support members.

2. The elastic foothold for stairs according to claim 1, wherein the upper plate further has one or more sixth coupling grooves formed on the top surface of the upper plate, and the elastic foothold for stairs further comprises an anti-slip plate having fourth coupling protrusions formed on a bottom surface of the anti-slip plateand corresponding to the sixth coupling grooves so as to be male-female coupled to the top surface of the upper plate, and a second anti-slip part formed on the top surface of the anti-slip plate.

3. The elastic foothold for stairs according to claim 1, wherein one or more guide rails are respectively formed from one side to the other of the bottom surface of the upper plate and the top surface of the lower plate such that the first block insertion parts and the second block insertion parts may move along the guide rails.

4. The elastic foothold for stairs according to claim 1, wherein the elastic foothold for stairs further comprises third blocks having guide coupling parts formed on bottom surfaces of the third blocks and corresponding to guide parts formed on the top surfaces of the second blocks so as to be coupled to the top surfaces of the second blocks, and both of the ends of the first elastic members are respectively coupled to the third coupling grooves and seventh coupling grooves.

5. The elastic foothold for stairs according to claim 1, wherein the first elastic members consist of springs coated with rubber, and the first elastic members further have support members installed in the central space of the first elastic members.

* * * * *